US007372973B2

(12) United States Patent
Meier

(10) Patent No.: US 7,372,973 B2
(45) **Date of Patent: *May 13, 2008**

(54) HEARING AID

(75) Inventor: Hilmar Meier, Männedorf (CH)

(73) Assignee: Phonak AG, Stafa (CH)

( * ) Notice: Subject to any disclaimer, the term of this patent is extended or adjusted under 35 U.S.C. 154(b) by 0 days.

This patent is subject to a terminal disclaimer.

(21) Appl. No.: 10/376,834

(22) Filed: Feb. 28, 2003

(65) Prior Publication Data

US 2003/0142843 A1 Jul. 31, 2003

Related U.S. Application Data

(63) Continuation of application No. 09/654,337, filed on Sep. 1, 2000, now Pat. No. 6,574,343, which is a continuation of application No. PCT/CH99/00093, filed on Mar. 1, 1999.

(51) Int. Cl.
*H04R 25/00* (2006.01)

(52) U.S. Cl. ..... 381/330; 381/313; 381/322

(58) Field of Classification Search ..... 381/322, 381/330, 71.7, 91, 23.1, 312, 313, 323, 324, 381/325, 326, 525, 328, 329, 355–360, 320, 381/327; 181/129, 130, 135; 607/55, 56, 607/559

See application file for complete search history.

(56) References Cited

U.S. PATENT DOCUMENTS

| | | | | |
|---|---|---|---|---|
| 3,265,153 | A | 8/1966 | Burroughs | |
| 3,770,911 | A | 11/1973 | Knowles | |
| 3,976,848 | A | 8/1976 | Estes | |
| 4,041,251 | A * | 8/1977 | Kaanders | 381/313 |
| 4,051,330 | A | 9/1977 | Cole | |
| 4,073,366 | A | 2/1978 | Estes | |
| 4,122,015 | A | 10/1978 | Oda | |
| 4,600,077 | A | 7/1986 | Drever | |
| 4,987,597 | A | 1/1991 | Haertl | |
| 5,003,606 | A * | 3/1991 | Bordewijk | |
| 5,133,016 | A * | 7/1992 | Clark | 381/328 |
| 5,187,746 | A * | 2/1993 | Narisawa | 381/323 |
| 5,204,917 | A | 4/1993 | Arndt | |
| 5,249,234 | A | 9/1993 | Butler | |
| 5,524,056 | A | 6/1996 | Killion | |
| 5,530,763 | A | 6/1996 | Aebi | |

(Continued)

FOREIGN PATENT DOCUMENTS

| | | |
|---|---|---|
| CA | 2024150 | 8/1990 |

(Continued)

OTHER PUBLICATIONS

English Abstract—Japanese Publication No. JP 08-251698, Publication Date: Sep. 27, 1996, Application No. JP 07-047232, Application Date: Mar. 7, 1995, Applicant: Rion Co., Ltd, Inventor: Yasuo Nishino (5 Pages).

*Primary Examiner*—Huyen Le
(74) *Attorney, Agent, or Firm*—Pearne & Gordon LLP

(57) ABSTRACT

A hearing device has a housing with an acoustic input aperture and an acoustic output aperture. A cover element overlays the input aperture. The material of the cover element permits passage of sound received at the input aperture though the material. Two microphones are located in the housing under the cover element. The cover element has an exterior surface that is flush with the exterior surface of the housing.

12 Claims, 6 Drawing Sheets

U.S. PATENT DOCUMENTS

| | | | | |
|---|---|---|---|---|
| 5,724,431 | A * | 3/1998 | Reiter et al. | |
| 5,790,672 | A | 8/1998 | Klostermeier | |
| 5,889,874 | A | 3/1999 | Schmitt et al. | |
| 6,069,963 | A | 5/2000 | Martin | |
| 6,424,721 | B1 * | 7/2002 | Hohn | 381/313 |
| 6,574,343 | B1 * | 6/2003 | Meier | 381/322 |

FOREIGN PATENT DOCUMENTS

| | | | |
|---|---|---|---|
| DE | 1 153 797 | | 12/1961 |
| DE | 1512667 | | 6/1969 |
| DE | 2 337 078 | | 7/1973 |
| DE | 42 05 376 | C1 | 2/1992 |
| DE | 4304085 | A1 | 8/1993 |
| DE | 196 03 806 | A1 | 2/1996 |
| DE | 196 35 229 | A1 | 8/1996 |
| DE | 296 23 264 | U1 | 10/1996 |
| EP | 0 310 866 | | 9/1988 |
| EP | 0 466 676 | A2 | 7/1990 |
| EP | 0 499 699 | A1 | 11/1991 |
| EP | 0 629 101 | A1 | 5/1994 |
| JP | 08-251698 | * | 9/1996 |
| JP | 8 251698 | | 9/1996 |
| WO | WO 97/45829 | | 12/1997 |

* cited by examiner

HEARING AID

CROSS-REFERENCE TO RELATED APPLICATION

The present application is a continuation of U.S. patent application Ser. No. 09/654,337 filed Sep. 1, 2000, now U.S. Pat. No. 6,574,343 which is a continuation of International Application No. PCT/CH99/00093 filed on Mar. 1, 1999.

BACKGROUND OF THE INVENTION

The present invention relates to a hearing aid defined in the preamble of claim 1.

Hearing aids comprise an acoustic input aperture to receive ambient sounds and an acoustic output aperture to emit the ambient sounds that were processed in the hearing aid. It is of foremost importance that spurious acoustic signals—which subsequently would be processed as being ambient sounds—should not be superposed on these ambient sounds. Spurious acoustic signals may arise from airflows detaching off edges or in the vicinity of the hearing aid (detachment problems) or from airflows of different speeds and/or directions in the immediate of the microphone membrane which would cause this membrane to move (gradient problems). These two sources of spurious acoustic signals also may be encountered in combination.

The U.S. Pat. No. 4,073,366 describes a cover element which is bonded across the acoustic input aperture of a hearing aid. This known cover element of several layers bonded together at their edges consists of a porous material, its purpose being to preclude spurious acoustic signals generated by airflows detaching off the edges of the said input aperture.

It was found however that this known design only little affects the majority of the spurious acoustic signals: even though the cover element across the acoustic input aperture does reduce gradient-induced spurious acoustic signals, it fails to affect detachment noises. The reason is that the cover element mounted across the acoustic input aperture to reduce flow detachment by its own edges gives rise to likely new sources of spurious acoustic signals. In this design the source of interfering spurious acoustic signals only has been shifted.

Reference is made for the sake of completeness to the European patent document 0,310,866 which discloses covering the acoustic output aperture with a preferably microporous cover element to prevent ear wax from penetrating the hearing aid. Said document also discloses covering the acoustic input aperture with a cover element in case an in-ear hearing aid is involved because in such a case ear wax only might penetrate the hearing aid when latter is inside the ear. Steps minimizing noise interference cannot be inferred from this document which merely concerns the prevent of hearing-aid soiling.

BRIEF SUMMARY OF THE INVENTION

Accordingly it is the objective of the present invention to create a hearing aid reducing the generation of spurious acoustic signal.

The invention offers the following advantages: Edges that would be sources of spurious acoustic signals are avoided by integrating at least one cover element into the hearing aid proper and in this manner the detachment problem has been met. At the same time the gradient problem also is solved in that the cover element is made of an open-pore material and assumes a given thickness.

It was found that an open-pore polyethylene is especially well suited as the cover element material. The material properties may be characterized on one hand by the filter fineness corresponding to the minimum particle size of the filtered particles and on the other hand by the open-pore ratio of the material, i.e. the ratio of pore apertures to residual surface. The filter fineness is stated in d50 values approximately, at which 50% of the particles pass the filter and 50% of them are retained by it. It was found that the d50 values are between 10 and 200 μm as regards filter fineness and the open-pore ratio is between 0.70 and nearly 1.00.

Because a homogeneous material is used for the cover elements, they are also highly reproducible because material discontinuities, which might degrade the acoustic properties of the overall system, are absent, since changes in material hold the danger of deviations from the normal acoustic behavior. Moreover both the manufacture and the installation of the cover elements of the invention into hearing aids is substantially simpler and hence also more economical.

In an embodiment variation of the invention, the homogeneously constituted cover elements are coated with a thin and permeable layer for instance of Teflon. Higher resistance is achieved thereby and is highly significant especially as regards external chemical factors. However the detachment problem also is taken into account because the coating imparts a finer surface to the cover element. In this manner spurious, acoustic detachment signals generated by roughnesses in the cover element surface are further minimized.

BRIEF DESCRIPTION OF THE SEVERAL VIEWS OF THE DRAWING

The invention is elucidated in illustrative manner in relation to the drawings.

DETAILED DESCRIPTION OF THE INVENTION

Figure 1:
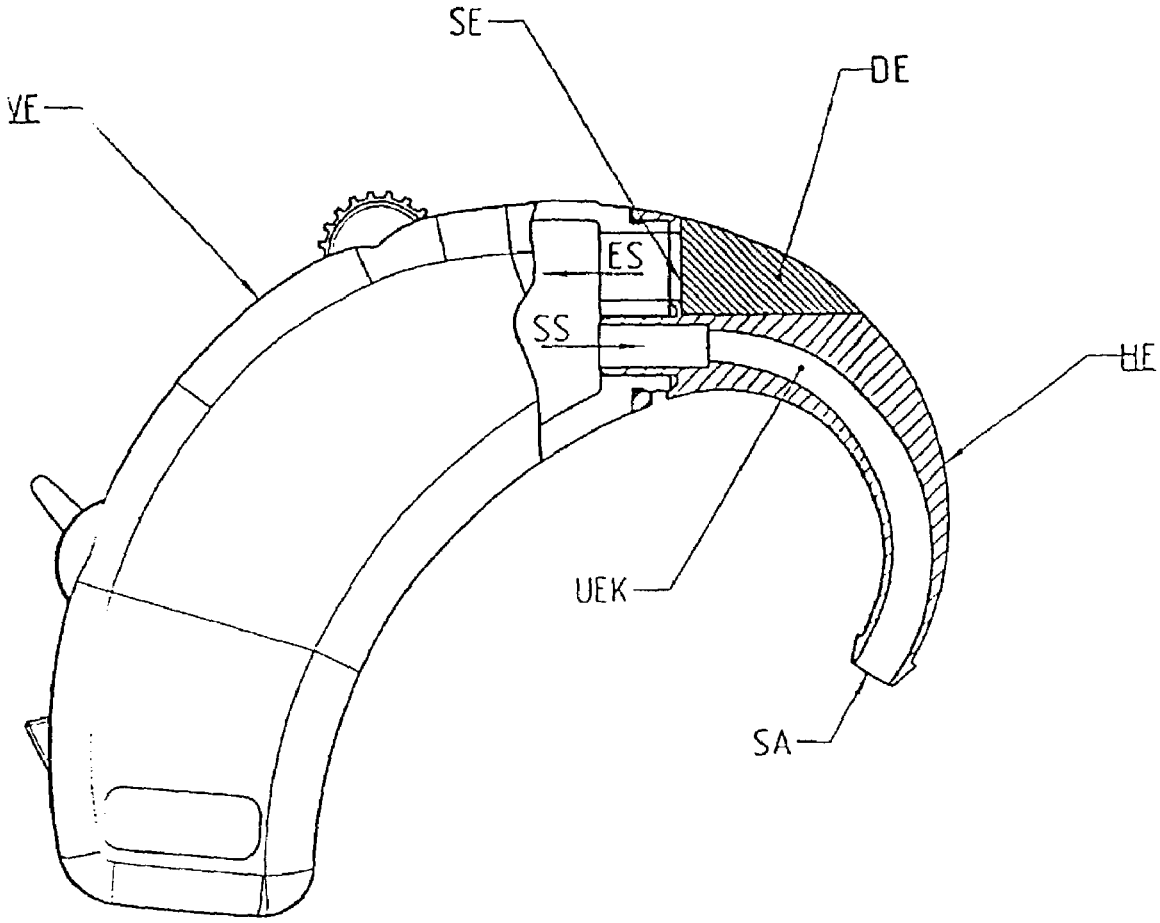
FIG. 1 is a longitudinal section through parts of a hearing aid of the invention with inserted over element.

FIG. 1 shows a longitudinal view of a hearing aid of the invention consisting of an amplifier VE and a hook HE. The hook HE is detachably connected to the amplifier VE, that is, the hook HE or the amplifier VE may be arbitrarily exchanged or replaced.

The amplifier VE substantially electronically processes the acoustic signals (see arrow ES) which, following processing, are transmitted to the hook HE (see arrow SS), i.e. to an acoustic transmission duct UEK contained therein. The hearing-aid's amplifier VE need not be elucidated herein because the objective of the invention foremost is the design of the hook HE.

It is emphasized however that the invention is not restricted to hearing aids consisting of two parts, namely an amplifier VE and a hook HE. Instead the invention also applies particularly to hearing aids consisting of a single housing part. Moreover the invention applies as well to in-ear hearing aids as to behind-the-ear hearing aids.

As regards the present invention, the external shape of the amplifier will be significant. In particular in the transition zone between the amplifier VE and the hook HE—again as regards the embodiment of FIG. 1—these two components comprise, if not identical, at least similar contours and surface properties. The hearing aid of the invention as a whole is free of sharp edges to preclude generating spurious sounds.

Preferably the hook HE is free of electronic components, in particular to it be capable to receive ambient sounds in the most interference-free manner and to transmit them in the direction of the arrow ES into the amplifier VE. On the other hand, the processed acoustic signals are transmitted in the direction of the arrow SS through the acoustic transmission duct UEK in the hook HE to an acoustic output aperture SA where the acoustic signals reach the hearing-aid wearer's auditory canal.

The invention provides a cover element DE in the hook HE which covers the zone o the acoustic input aperture SE relative to the ambient, the cover element DE being integrated in such manner into the hook HE that edges at the transition sites between the hook HE and the cover element DE shall not project, that is, the cover element DE is integrated into the hook so that their two surfaces shall be flush. Moreover the cover element DE is externally spherical or at least spherical in parts. In this manner the hearing aid is free of edges that might generate spurious acoustics.

As already mentioned above, the materials used for the cover elements are porous, preferably being open-pored in a manner defined by the two parameters of filter fineness and open-pore ratio. Also the material used in the invention in one embodiment mode is homogeneous in structure.

It was found that especially good results will be attained if the said material is of a filter fineness between 10 and 200 μm (given in d50 values) and has an open-pore ratio between 0.70 and nearly 1.00. However the selection of these parameters and especially of filter fineness is significantly affected by the cover element's thickness, i.e. by its volume. It was found in this respect that the largest possible volume of a cover element is advantageous in reducing the gradient effect. On the other hand a volume increase at the same time changes in undesired manner the acoustic impedance. Therefore a tradeoff must be found between these two optimization conditions, as shall be elucidated further below in relation to FIG. 2.

The following materials are especially appropriate for this invention: sintered polymers, polyethylene, foam ceramics (also: ceramic foam), foamed polyurethane, sintered glass or sintered metal.

As already mentioned above, the cover element is made of a homogeneous material. A further implementation of the invention proposes to coat the cover element's outside with a thin, fine-pored layer. Preferably such a layer shall consist of Teflon. Such a layer offers the advantages of increasing chemical resistance and thereby the hearing aid of the invention can be used under adverse ambient conditions. While repelling water, body sweat and body fat is necessary and demanded for the daily use of hearing aids, special storage conditions conceivably will also require repelling other chemicals and make such an additional feature desirable.

Resistance to weather is of great importance when using hearing aids daily and can be achieved by using a hydrophobic or oleophobic cover element or at least hydrophobing the surface, or coating it with a hydrophobic material.

Figure 2:
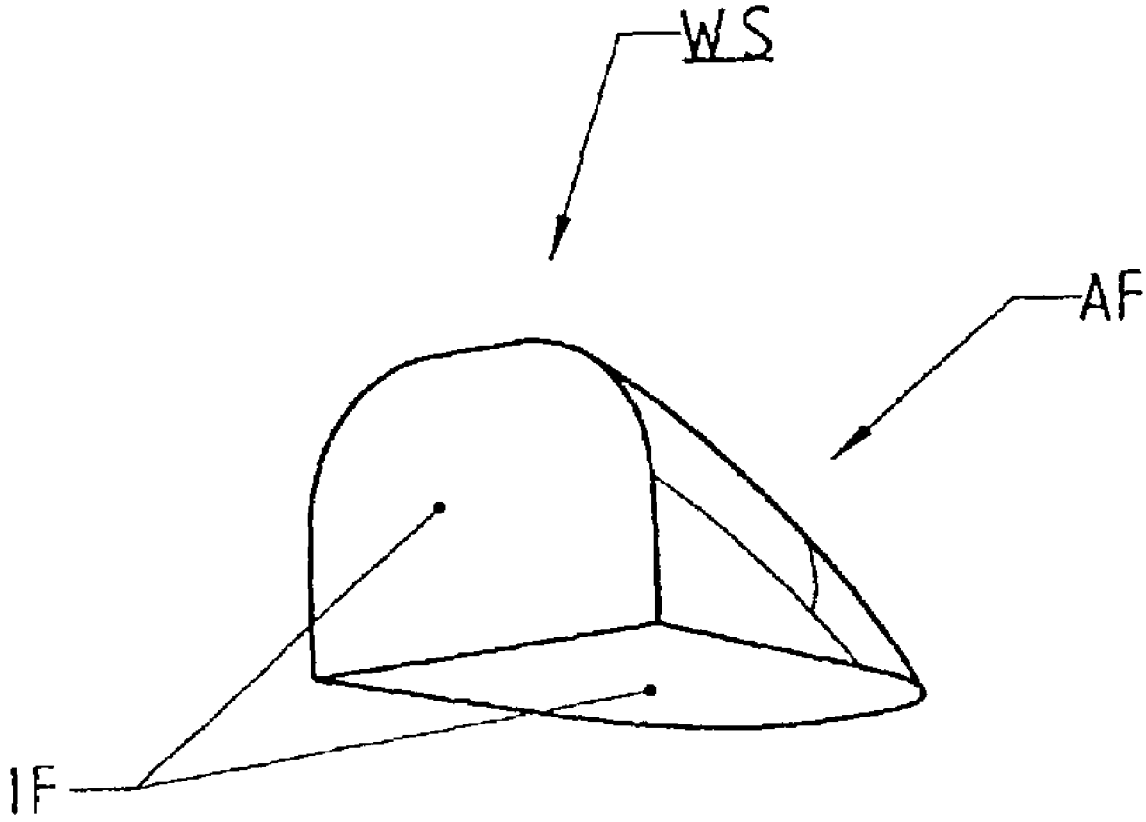
FIG. 2 is a perspective of the cover element of FIG. 1.

FIG. 2 is a perspective of the cover element DE for the hearing aid of the invention of FIG. 1. Said cover element comprises an outwardly directed surface AF and inwardly directed surfaces IF. The division of the surface AF into three areas merely serves to indicate the surface curvatures and otherwise implies no significance. The same consideration applies to the four inward partial surfaces of the inwardly surface IF.

Because of its large volume, the cover element DE shown in FIG. 2 offers good behavior as regards the gradient effect. However this large volume also entails limitations regarding the acoustic impedance properties of the hearing-aid's unit. The latter drawback can be countered by selecting a fine pore structure preferably at 80 to 100 μm (d50 values).

Figure 3:
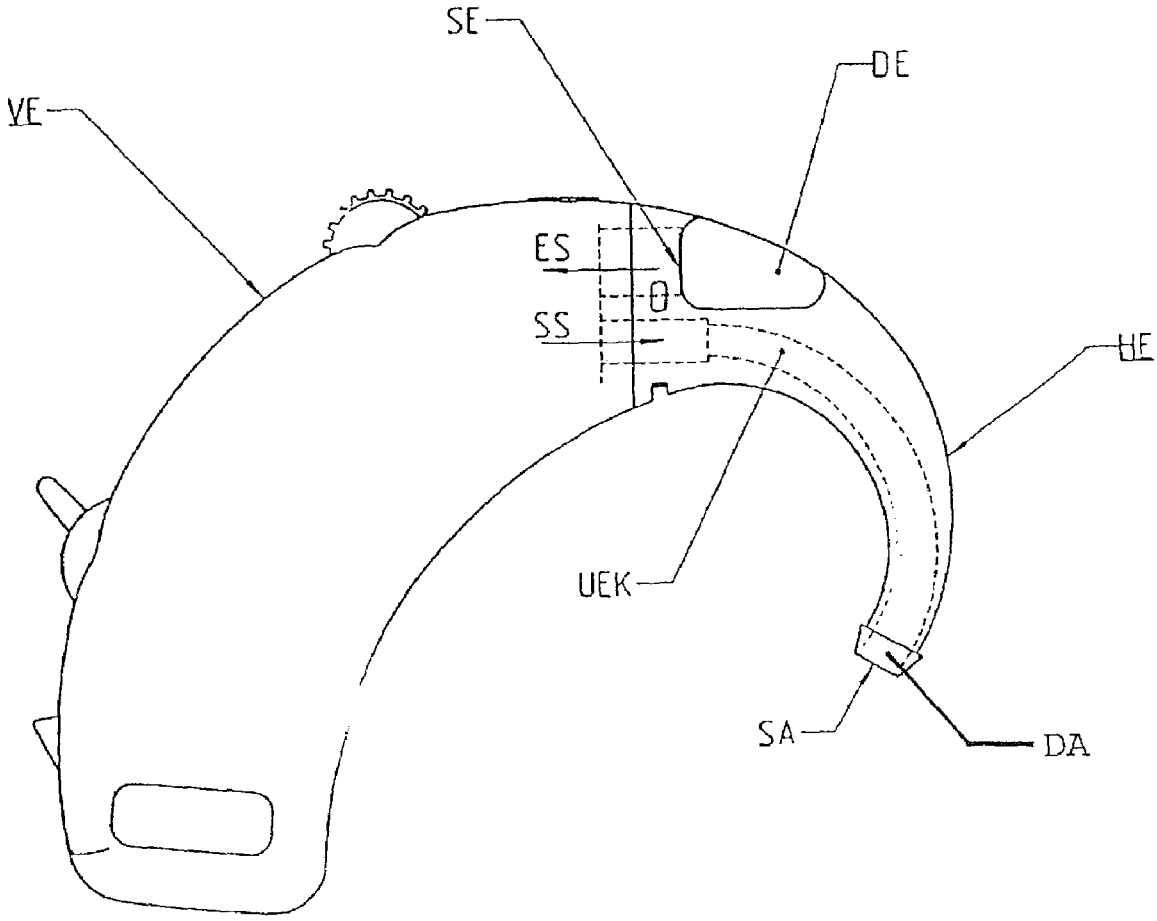
FIG. 3 is a sideview of another embodiment of a hearing aid of the invention with inserted cover element.

As does FIG. 1, FIG. 3 shows a longitudinal section of the hearing aid of the invention, those components already used in the hearing aid of FIG. 1 also being denoted by the same references in FIG. 3.

As shown by FIG. 3, the cover element of this embodiment is rounded off in the edge zones. The clearance in the hook HE receiving the cover element DE has been matched to the latter's external shape. This embodiment of the invention offers the additional advantage of a more compact and more dimensionally stable design than attained in the embodiment variation of FIG. 1. In the present case, the cover element DE is so enclosed by the hook HE that the freedom of motion of this cover element DE is restricted radially. For its installation and removal, the cover element DE may be displaced perpendicularly to the plane of the drawing of FIG. 3. A further cover DA may cover the acoustic output aperture SA.

Figure 4:
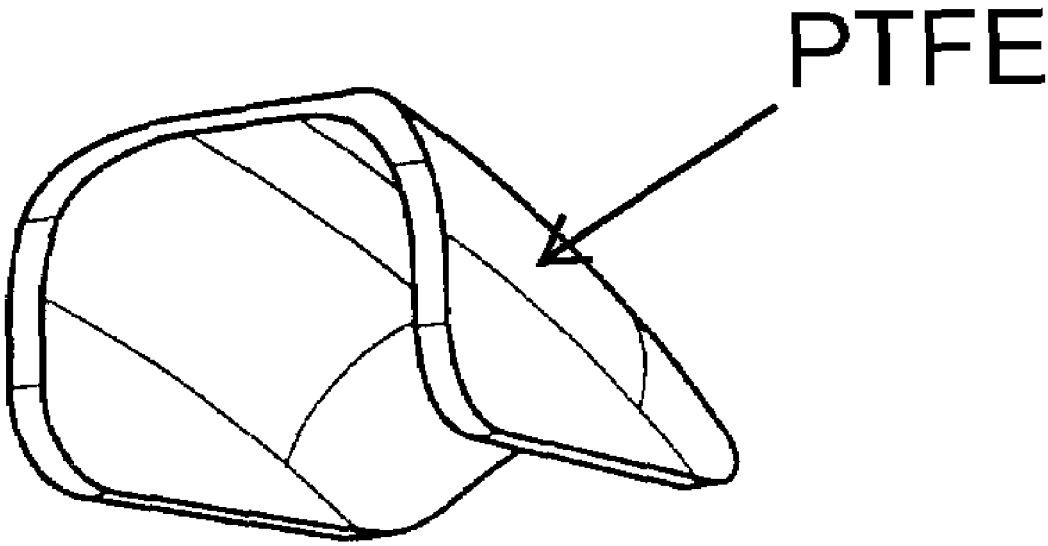
FIG. 4 is a perspective of the cover element of FIG. 3.

FIG. 4 shows the cover element DE that may be inserted into the hearing aid of FIG. 3. Asides the differences already cited above relative to the embodiment of FIGS. 1, 2, the cover element DE of FIG. 4 is in the form of a shell, that is, while the outwardly directed surfaces remain unchanged, the volume of porous material is reduced. The cover element has a polytetrafluorethylene PTFE layer on its outside. A filter fineness preferably between 10 and 40 μm shall be selected for such a shell design, the shell's thickness being at least 0.5 mm.

Figure 5:
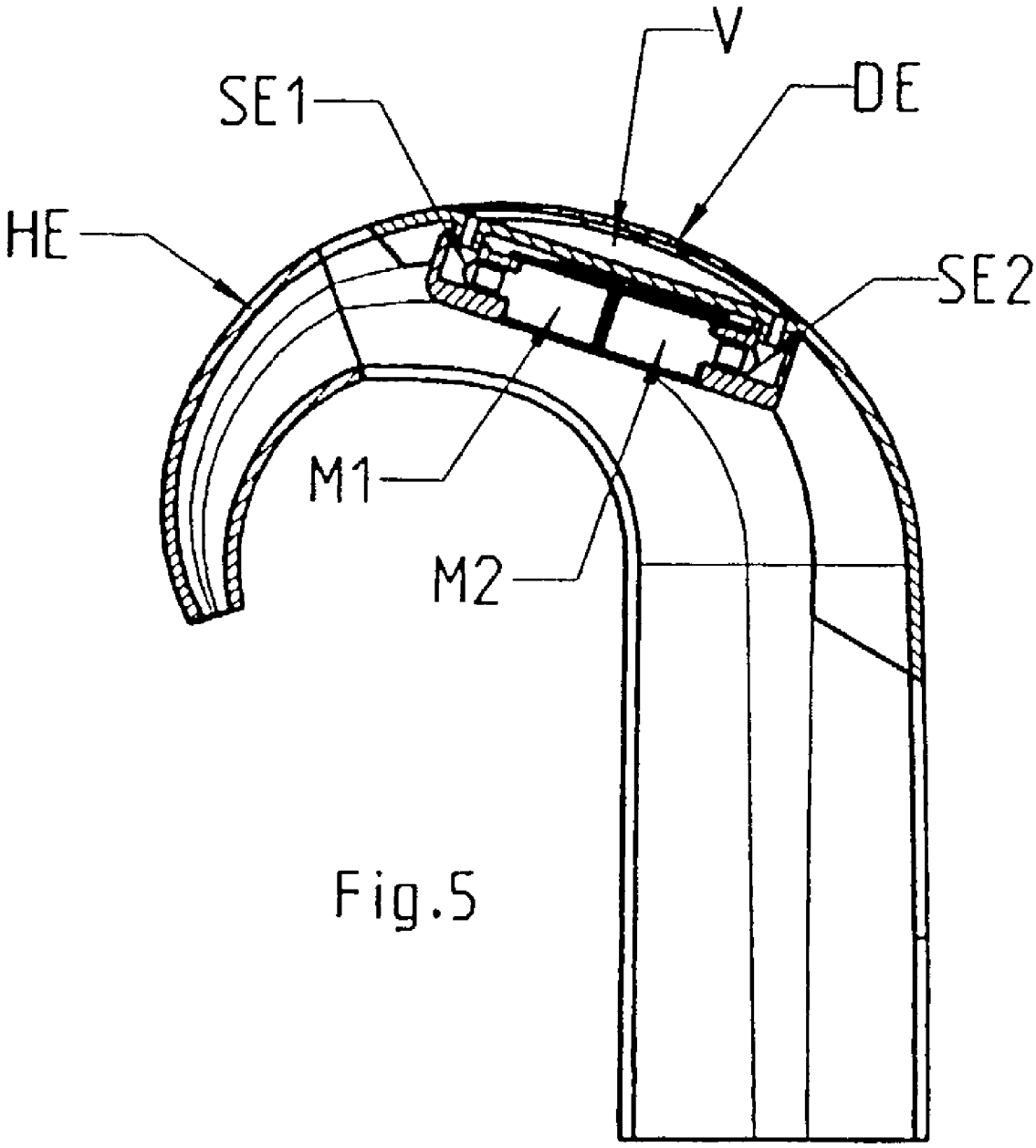
FIG. 5 is a longitudinal section of a hearing aid of the invention comprising several microphones.

Lastly FIG. 5 shows a hearing-aid embodiment using two microphones M1 and M2 to control the directional characteristics. In this invention, the two microphones M1 and M2 are mounted under the same cover element DE. The cover element DE is in the form of a shell and subtends a volume V fitted with acoustic input apertures SE1 and SE2 near a respective microphone M1 and M2.

It is well known, when using several microphones to control the directional characteristics, that matching the two microphones is critical. This matching is best attained in that two microphones M1 and M2 shall be mounted under the same cover element DE, whereby the volumes V in front of the microphones also shall be identical. Unavoidable soiling of the outwardly directed surface of the cover element DE will then equally affect the two microphones M1 and M2.

Figure 6A:
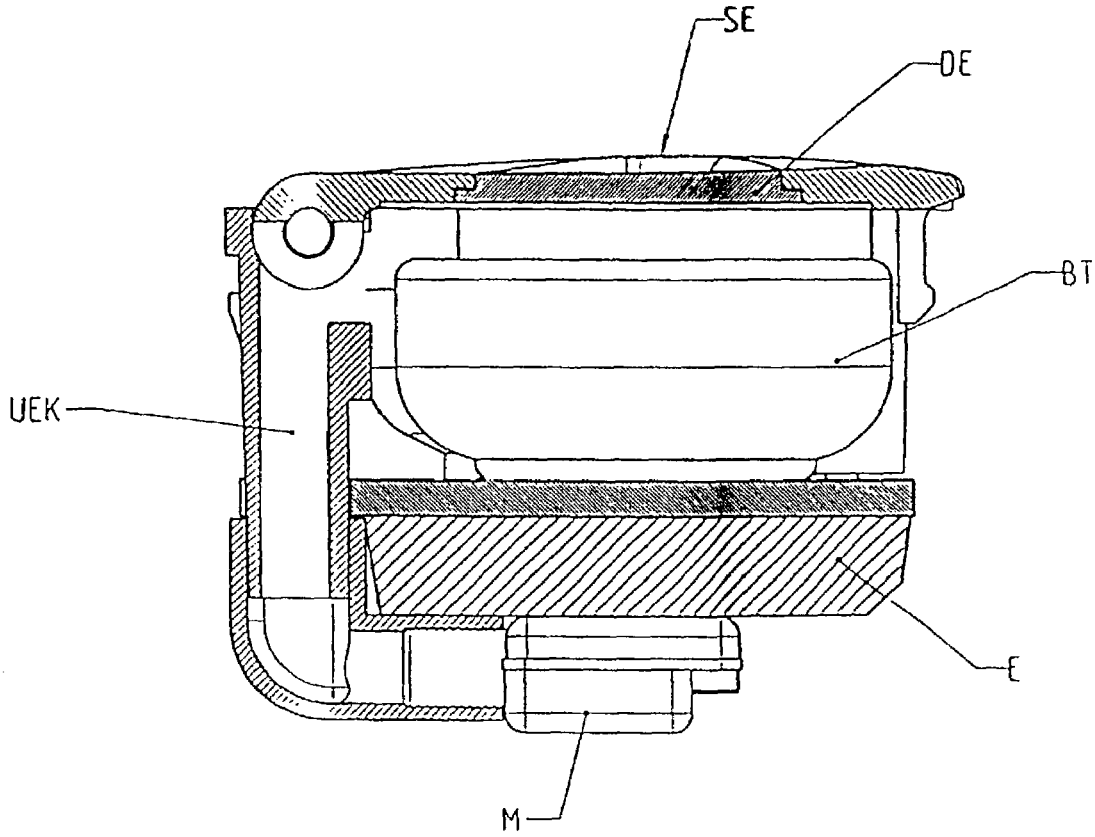
FIGS. 6*a*, 6*b* are a section and a topview resp. of an in-ear hearing aid fitted with a cover element of the invention.
Figure 6B:
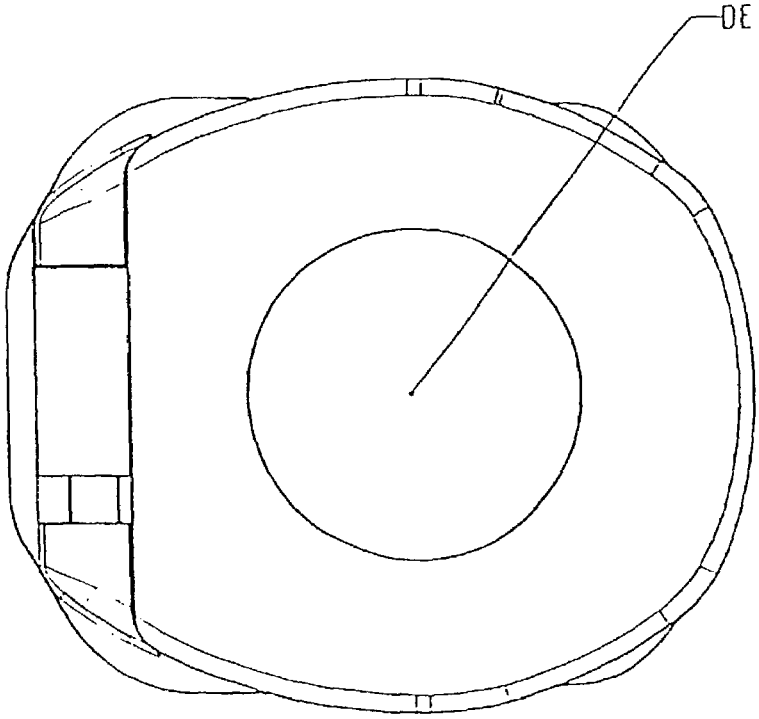

FIG. 6 shows an in-ear hearing aid, with FIG. 6A being a cross-section and FIG. 6B a topview. In FIG. 6A the cover element again is denoted by DE and covers an acoustic input aperture SE. An acoustic duct UEK also is shown which transmits sound waves to a microphone M. For the sake of completeness; FIG. 6A also shows a battery BT and a housing E containing the electronics.

The topview of FIG. 6B shows the cover element DE which in this embodiment preferably shall be a spherical segment.

Compared to the embodiments of FIGS. 1 through 5, the in-ear hearing aid design of FIG. 6 mostly differs by a different configuration of the hearing-aid components. However the principle of the invention remains unaffected thereby.

The above discussions concern hearing aids of which the acoustic input apertures are fitted with an appropriate cover element. In a further embodiment of the invention, the acoustic output aperture also shall be fitted with a cover element (DA). In this manner, the resulting hearing aid shall be optimal not only with respect to acoustic behavior but also and especially it shall be designed against all degrading external factors.

In this respect, cover elements for vents also are conceivable. Illustratively, when using zinc-air batteries, an air supply must be assured. The above discussed cover elements are eminently suitable for such purposes and in such an application the cover element shall be integrated preferably in surface-continuous manner into the hearing-aid unit.

What is claimed is:

1. A hearing device comprising:

a housing with an acoustic input aperture and an acoustic output aperture;

at least two microphones, each having an acoustic inlet; and a substantially rigid cover element overlaying said acoustic input aperture, and designed as a shell having a thickness of at least 0.5 mm, a material of the cover element having a filter fineness between 10 μm to 200 μm and an open-pore ratio between 0.70 and 1.00, the cover element at least partially defining a volume under the cover element, wherein the acoustic inlets of the microphones are in communication with the volume.

2. Hearing device as claimed in claim 1, wherein the surface of said cover element is integrated into the hearing device housing in such manner that the surface of said cover element is flush with a surrounding surface of the housing.

3. Hearing device as claimed in claim 1, wherein said cover element is made of a sintered polymer, foam ceramics, sintered glass or sintered metal.

4. Hearing device as claimed in claim 1, wherein the cover element is made of a material that is at least hydrophobic or oleophobic.

5. Hearing device as claimed in claim 1, wherein the cover element has a polytetrafluorethylene layer on its outside.

6. Hearing device as claimed in claim 1, wherein the structure of the cover element is homogenous.

7. Hearing device as claimed in claim 1, wherein the acoustic input aperture and the cover element are received in a hook that is detachably connected to an amplifier.

8. Hearing device as claimed in claim 1, wherein the hearing aid housing is fitted with a vent assuring air supply to a zinc-air battery, said vent being covered by a further cover element which is integrated into said housing and of which the surface is flush with that of the housing.

9. A hearing device comprising:

a housing with an acoustic output aperture;

a substantially rigid cover element designed as a shell having a thickness of at least 0.5 mm; and at least two microphones configured under the cover element and in acoustic communication therewith, said microphones connected to provide directional characteristics, a material of the cover element having a filter fineness between 10 μm to 200 μm and an open-pore ratio between 0.70 and 1.00.

10. Hearing device as claimed in claim 1, further comprising a further cover element covering the acoustic output aperture.

11. Hearing device as claimed in claim 10, wherein the acoustic output aperture and the further cover element are received in a hook which is detachably connected to an amplifier.

12. Hearing device as claimed in claim 10, wherein one of the cover elements is detachably connected to the hearing device housing.

* * * * *